US006505554B1

(12) United States Patent
Rhein

(10) Patent No.: US 6,505,554 B1
(45) Date of Patent: Jan. 14, 2003

(54) SCREEN PRINTING PROCESS WITH DIMINISHED MOIRE EFFECT

(76) Inventor: Ralph Rhein, 4320 Valley Rd., Racine, WI (US) 53405

( * ) Notice: Subject to any disclaimer, the term of this patent is extended or adjusted under 35 U.S.C. 154(b) by 0 days.

(21) Appl. No.: 09/897,343

(22) Filed: Jul. 3, 2001

(51) Int. Cl.[7] ..... B41C 1/14; B41F 15/10

(52) U.S. Cl. ..... 101/129; 101/115; 101/490; 101/128.4; 358/1.9

(58) Field of Search ..... 101/114, 115, 101/123, 128.4, 129, 424.1, 490, 128.21; 358/1.9, 1.2

(56) References Cited

U.S. PATENT DOCUMENTS 5,155,599 A 10/1992 Delabastita ..... 358/298
5,381,247 A 1/1995 Hains ..... 358/533
5,752,441 A * 5/1998 Karlyn et al. ..... 101/127.1
5,778,091 A 7/1998 Shibazaki et al. ..... 358/534
5,953,988 A 9/1999 Vinek ..... 101/129
6,072,592 A 6/2000 Ashworth ..... 358/1.9

* cited by examiner

*Primary Examiner*—Leslie J. Evanisko
(74) *Attorney, Agent, or Firm*—Jansson, Shupe & Munger, Ltd.

(57) ABSTRACT

A process of screen printing images on a substrate which effectively diminishes the Moire effect and other screen printing process distortions. The process utilizes specific screen angles for printing each process ink color, the application of UV light to set the ink on the substrate and the automated transfer of the substrate between printing and drying stations.

20 Claims, 7 Drawing Sheets

SCREEN PRINTING PROCESS WITH DIMINISHED MOIRE EFFECT

FIELD OF THE INVENTION

This invention relates generally to the screen printing of inks onto substrates, and in particular, to a process of screen printing which diminishes or eliminates the Moire effect and other visual discrepancies between the original image and printed reproductions.

BACKGROUND OF THE INVENTION

The screen printing process is a process of forcing ink through unblocked areas of a metal, synthetic or silk fiber screen by spreading the ink onto the screen and passing a squeegee over the screen. This process is typically used in the production of posters, signs, decalcomania, etc. Most screens are comprised of polymeric or metal threads.

It is known to screen print images on substrates through the successive application of single tones of ink. This printing process achieves tone variation by separating each process color, typically cyan, magenta, yellow and black, into fine dots of differing size on a halftone screen grid. Typically, the dots are closely spaced and arranged in parallel lines. Image coloring can be varied by superimposing the dots of the process colors. In an ideal embodiment of the printed reproduction, human vision integrates the dots into an accurate impression of the original image.

However, the use of four separate colors printed successively through a screen often results in the presence of Moire effects. A Moire effect is a repetitive interference pattern caused by overlapping symmetrical grids of dots or lines having a differing pitch or angle. Such effects are often seen as waves, shimmering or rosettes in the reproduced image.

It is understood that Moire effects are introduced by the application of the dot pattern to the screen which causes the dot shapes to be resized by the screen structure, depending on the size of the dot and the screen cell. The interference between the screen structure pattern and the dot pattern will be repeated for each color and results in Moire effects.

In order to avoid Moire effects, it is known to vary the dot arrangements for each color. For instance, U.S. Pat. No. 5,778,091 to Shibazaki et al. discloses the printing of cyan with a dot pattern axis of 15 degrees, magenta with a dot pattern axis of 45 degrees, yellow with a dot pattern axis of 0 degrees and black with a dot pattern axis of 75 degrees. While these screen angles do diminish Moire effects, discrepancies between the original image and the reproduced image still exist due to Moire.

At least some of these discrepancies are caused by positional shifts or deviations caused by the mechanical factors of the screen printer and the ink setter. Specifically, heat storage effects of these devices cause deformation in the ink receiving substrate. For each ink printing onto the substrate and setting or drying in position, the substrate is heated and cooled several times. Typically, the ink is passed under several heating/drying elements which can cause the substrate to deform or shrink by an ⅛inch each pass. After an ink is set, the substrate must be realigned and re-registered with another screen for the printing of other process colors. The deformation of the substrate can significantly impair this realignment and cause dramatic positional shifts or deviations.

An improved screen printing process which addresses these problems of known screen printing processes would be an important advance in the art.

OBJECTS OF THE INVENTION

It is an object of the invention to provide a screen printing method overcoming some of the problems and shortcomings of prior art screen printing processes.

Another object of the invention is to provide a screen printing method which diminishes or eliminates interferences between dot and screen patterns.

Another object of the invention is to provide a screen printing method which reduces Moire effects to a minimum.

Another object of the invention is to provide a screen printing method which utilizes the same standard screens for each ink application.

Another object of the invention is to avoid Moire effects in screen printing without utilizing expensive, specially made screens.

Still another object of the invention is to provide a screen printing method which reduces ink-receiving substrate deformation.

Still another object of the invention is to provide a screen printing method which reduces the need for repeated registration of the substrate during the printing process.

Yet another object of the invention is to provide a precise screen printed image which results from the novel process herein described.

How these and other objects are accomplished will become apparent from the following descriptions and the drawings.

SUMMARY OF THE INVENTION

The new screen printing process is intended to result in an extremely precise and accurate screen printed reproduction of an original image. The process utilizes novel screen angles and ink drying processes which are able to reduce dot and screen pattern interference, position shifts and substrate deformation. The method of screen printing the image onto a substrate comprises the steps of (1) separating the original image into cyan, magenta, yellow and black components at a predetermined line count, (2) converting each color component into linear dot patterns on respective process films with axes at respective angles relative to the vertical, (3) transferring the linear dot patterns from the respective process films to respective screens, (4) securing the substrate in a fixed position relative to an automated substrate-guide or gripper which is able to automatically transport the substrate between ink-receiving and ink-drying positions, (5) transferring the substrate to an ink-receiving position while retaining the fixed position relative to the substrate-guide, (6) aligning a screen with the substrate, (7) applying ink to the screen so that the ink flows through the dot pattern on the screen onto the substrate, (8) transferring the substrate to an ink-drying position while retaining the fixed position relative to the substrate-guide, (9) setting the ink on the substrate through the application of light, and (10) repeating steps 5–9 for each desired process color.

The preferred substrate is a smooth material such as vinyl, other polymeric materials typically used for posters and the like, or paper coated with such material.

The precision of this screen printing process demands that the substrate be extremely smooth and able to retain ink so that the image can be properly reproduced.

It is preferred that the linear dot patterns are positioned on the process films at specific angles which have been determined to be proficient at minimizing Moire effects. One set of these angles is 82.5 degrees for cyan, 142.5 degrees for magenta, 7.5 degrees for yellow and 22.5 degrees for black. It is to be understood that all angle measurements disclosed and claimed in this patent are relative from the vertical axis, such that a "3 o'clock" angle would be 90 degrees and an "11 o'clock" angle would be 330 degrees. It is further understood that the effectiveness of these angles is due to their relationship with the geometry of the screen. Orthogonal screens have threads which run vertically and horizontally, creating rectangular screen cells. The angle measurements are effective when they are measured relative to the vertical screen threads. It is contemplated that any angular rotation of the screen threads would result in "different" angle measurements which would minimize Moire. In accordance, the angles claimed in relation to the "vertical" refer to the vertical axes of the screen threads.

Another preferred set of angles determined to be extremely effective at minimizing Moire effects is 75 degrees for cyan, 135 degrees for magenta, 0 degrees for yellow and 15 degrees for black.

Each set of preferred angles utilizes the same angular displacement between pairs of dot patterns. Specifically, the angular displacement between the cyan dot pattern axes and the magenta dot pattern axes is 60 degrees. The angular displacement between the cyan dot pattern axes and the yellow dot pattern axes is 285 degrees. The angular displacement between the cyan dot pattern axes and the black dot pattern axes is 300 degrees. The angular displacement between the magenta dot pattern axes and the yellow dot pattern axes is 225 degrees. The angular displacement between the magenta dot pattern axes and the black dot pattern axes is 240 degrees. The angular displacement between the yellow dot pattern axes and the black dot pattern axes is 15 degrees.

The dot pattern of each color is created in order to properly represent the final reproduced image. A preferred dot pattern comprises either 24, 36, 45, 60, 62, 70 or 82 dot-positions per inch. A dot-position is a rectangular area in which a single dot is placed.

If the image color at a specific position does not require the presence of a certain process color, then the dot-position for that process color at that position will be empty. Conversely, if the image color at a specific position requires the full density of a process color then the dot-position for that process color will be completely filled by ink and the dot will be a rectangle. As the size of the dot increases from an empty dot-position to filled dot-position it transforms from a small substantially circular dot to a diamond shape, or ellipse. When the dot covers approximately 30–41% of the dot-position it merges with the proximate dot in the linear pattern. When the dot covers approximately 65–70% of the dot-position it merges with the proximate dot perpendicular to the linear pattern.

The shape of the dots utilized in the invention are preferably elliptical or rugby-shaped when medium sized. Rugby-shaped refers to the shape of a rugby football, which is similar to an elliptical shape though flatter at each end. Medium sized refers to the range of dot size when the dot covers approximately 20–50% of the dot-position. As the dot size moves from 20% to 50% the dot merges or joins its neighboring dot in the linear pattern.

The preferred screens for use in the claimed invention are flat screens as are known in the art. The screens are preferably orthogonally arranged such that the screen threads pass vertically and horizontally across the screen, intersecting at right angles. The resulting screen cells are rectangular, and typically square. The screen typically includes a rectangular frame which keeps the threads under tension.

During the transfer of the dot pattern to the screen from the process film, the screen cells correlating to the dot pattern on the film are unblocked and the other screen cells are blocked so that an area corresponding to the dot pattern is created through which ink is able to pass.

It is preferred that the dot pattern is transferred from the process film to the screen using photo emulsion. Typically during photo emulsion the screen is coated with emulsion that is dried. The film is aligned next to the screen so that the dot pattern angle on the film is properly oriented with respect to the vertical threads of the screen. Light is passed through the film onto the emulsion covered screen for an extended period of time. During this period the emulsion which light touches hardens and blocks screen cells. The emulsion which is shaded by the film's dot pattern does not receive light and stays unhardened and soluble in water. The film is removed from the screen and water is sprayed over the screen, removing the emulsion which was shaded by the film's dot pattern. In this manner, unblocked screen cells and partially unblocked screen cells substantially duplicate the dot pattern of the process film. The dot pattern can be better duplicated by screens in which the threads are thin and spaced closely together. Screens with synthetic threads are typically able to provide superior duplication since synthetic threads can be made much thinner than silk or metal threads. The screens utilized in the invention typically have 380 to 420 threads per inch.

After the film's dot pattern is transferred to the screen, the screen is placed next to the ink receiving substrate which is fixed in position relative to a substrate-guide, preferably a gripper. It is preferred that the screen is aligned with the substrate using register marks. This is particularly important for the screens which are utilized after the first color printing. For these screens, the register mark from the first printing is aligned so that the subsequent inks are printed in the correct relationship to the first ink. The substrate need not be registered in the ink-receiving position since it is secured to the substrate-guide or gripper which automatically aligns itself precisely with respect to the ink-receiving position.

After ink is printed onto the substrate, the ink must be set or dried. The substrate-guide or gripper transfers the substrate from the ink-receiving position adjacent to the screen to an ink-drying position. The drying process is preferably performed using UV light. The application of UV light results in much less heat being absorbed by the substrate than in most prior art ink setting processes. In addition, the application of UV light can be accompanied by heat transfer away from the substrate by water-cooling the table on which the substrate lies. Furthermore, the drying process using UV light can be performed more quickly than prior art processes.

Once the most recently printed ink is set, the substrate guide or gripper transfers the substrate to an ink-receiving position where the next screen is positioned adjacent to the substrate for printing the next ink. This process is repeated for each ink which is necessary to create a satisfactory reproduced image. It is preferred that cyan is printed first, followed by magenta, yellow and black. However, this order is not compulsory in achieving satisfactory results. Often the process requires cyan, magenta, yellow and black. However, it is understood that some images may require only one, two or three of these process colors.

Because the substrate-guide or gripper is able to transfer the substrate between each ink-receiving position each ink-drying position the substrate does not need to be re-registered each time it is transferred between these positions. This allows significantly more precision than in the prior art process of manually transferring the substrate to and from each device and re-registering the substrate.

DETAILED DESCRIPTION OF PREFERRED EMBODIMENTS

Figure 1:
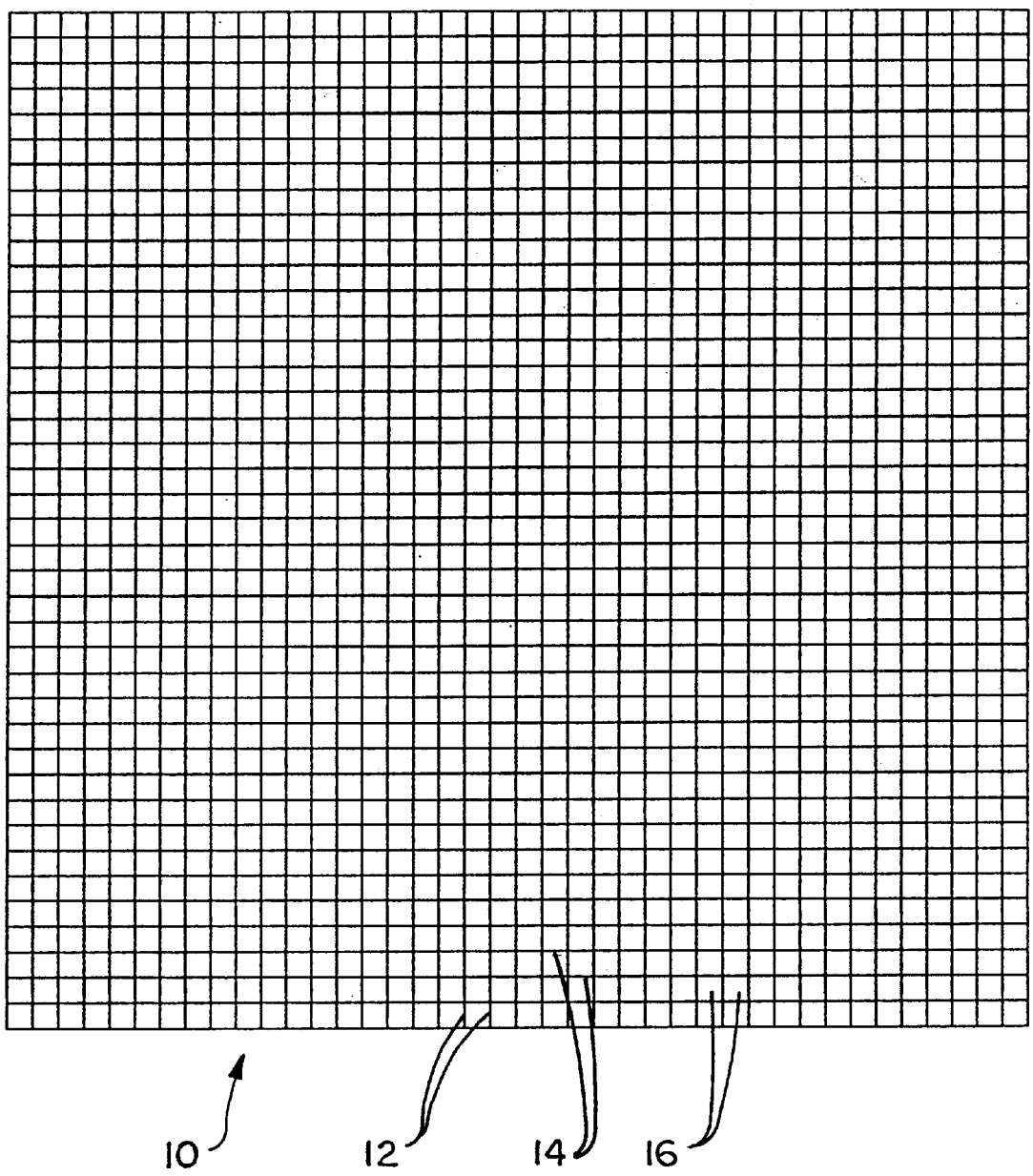
FIG. 1 is a magnified view of an orthogonal screen used in the preferred method of printing.

Referring to the figures, details of the screen printing process with diminished Moire effect will be set forth. FIG. 1 depicts a magnified view of a screen 10. The screen 10 is comprised of parallel vertical threads 12 and parallel horizontal threads 14 which run perpendicularly to the vertical threads 12. The vertical and horizontal threads 12,14 define screen cells 16. In their original state all the screen cells 16 are open and allow fluids to pass through the screen 10.

In the preferred embodiment, about 380–420 vertical threads 12 pass through each square inch of screen 10. Likewise, in the preferred embodiment, about 380–420 horizontal threads 14 pass through each square inch of screen 10. Therefore, in the preferred embodiment, there are between about 144,400 and 176,400 screen cells 16 per square inch of screen.

Figure 2:
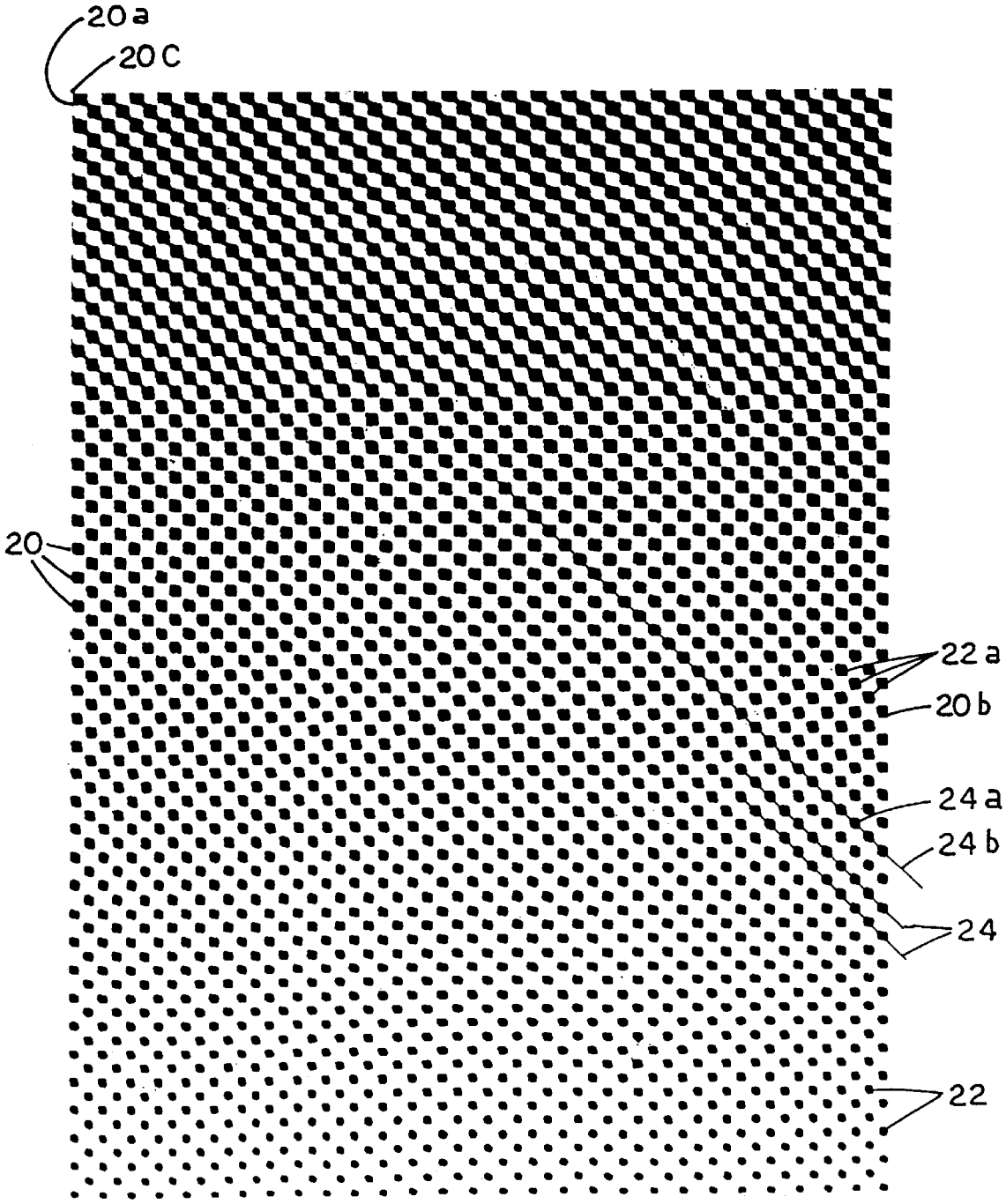
FIG. 2 is a magnified view of a parallel dot patterns typical of the dot patterns used in the preferred method of printing.

FIG. 2 depicts a magnified view of a parallel linear dot patterns 20 typical of the dot patterns used in the preferred method of printing. Each of the dot patterns 20 in FIG. 2 runs from the bottom or right edge of the figure to the left or top edge. For example dot pattern 20*a* runs from position 20*b* to position 20*c*. It can be seen that the dots 22*a* of dot pattern 20*a* grow in size as the pattern moves from 20*b* to 20*c*.

Each dot 22 is positioned in a dot-position (not shown). In the preferred embodiment there are between about 62 and 82 dot-positions per inch. Towards the bottom of the figure the dots 22 cover less than 10% of their respective dot-positions. Towards the top of the figure the dots 22 cover more than 70% of their respective dot-positions. It is understood that the coverage of dot-positions ranges from 0–100% and is dependent upon the color, tone and shade of the image to be reproduced.

The axis 24*b* of dot pattern 24*a* is parallel to all other dot pattern axes 24 in the figure. As will be discussed in below, these axes 24 are positioned in specific angular relationships with the vertical threads 12 of the screen 10 when the dot patterns 20 are transferred to the screen 10.

Figure 3:
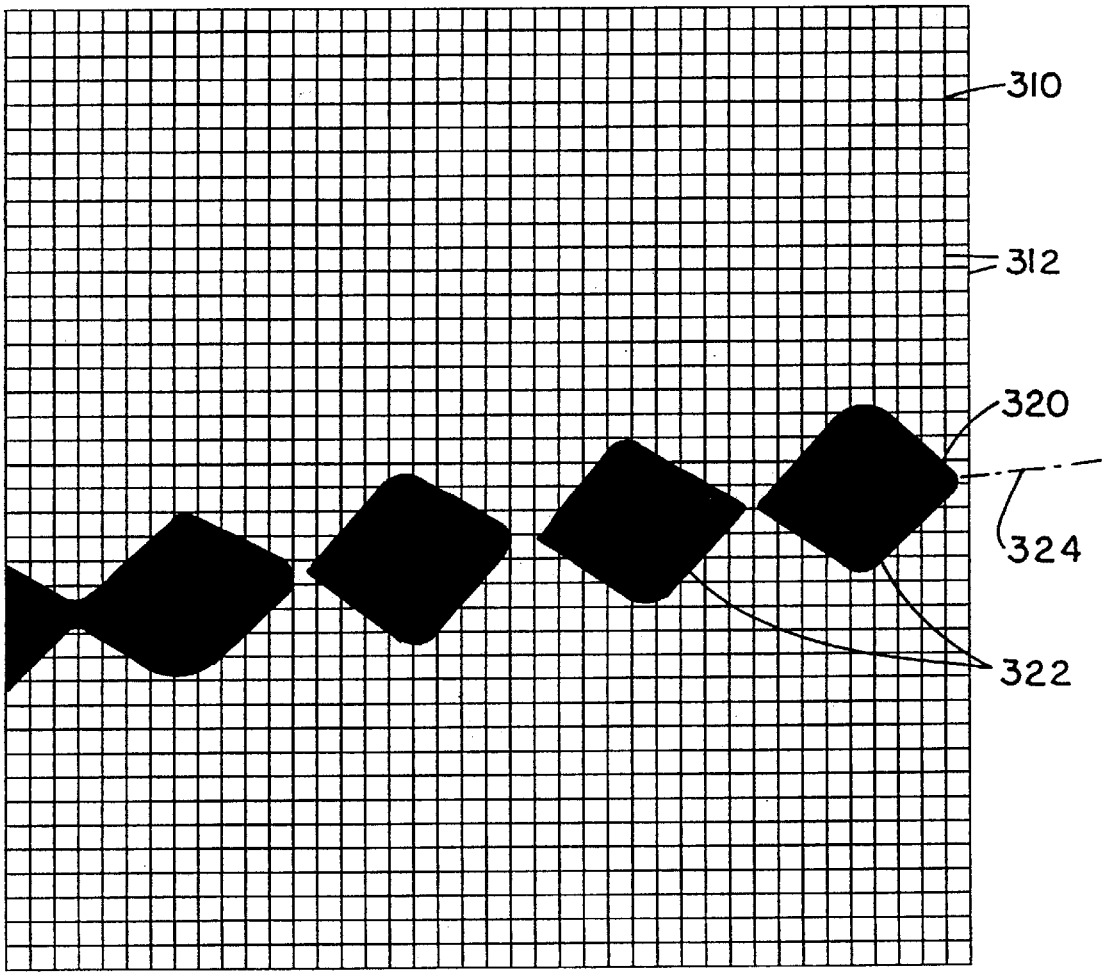
FIG. 3 is a magnified view of a process film with a single linear dot pattern overlying an orthogonal screen.

FIG. 3 depicts the magnified view of a process film with a single linear dot pattern 320 overlying an orthogonal screen 310. It is preferred that during the transfer of the dot pattern 320 from the film to the screen, the orthogonal screen has been coated with emulsion. The dots 322 cover approximately 25–45% of their respective dot-positions. The axis 324 of the dot pattern 320 crosses the vertical threads 312 at an angle of approximately 82.5 degrees as is preferred for the cyan dot patterns.

When the dot pattern 320 of the process film is aligned over the screen 310 correctly, the process film and screen 310 are held in position and light is applied to the composite for an extended period of time allowing the exposed emulsion to harden. After a sufficient period of time the film is removed to reveal unhardened emulsion covered areas on the screen 310 which correspond to the dot pattern 320 of the process film.

Figure 4:
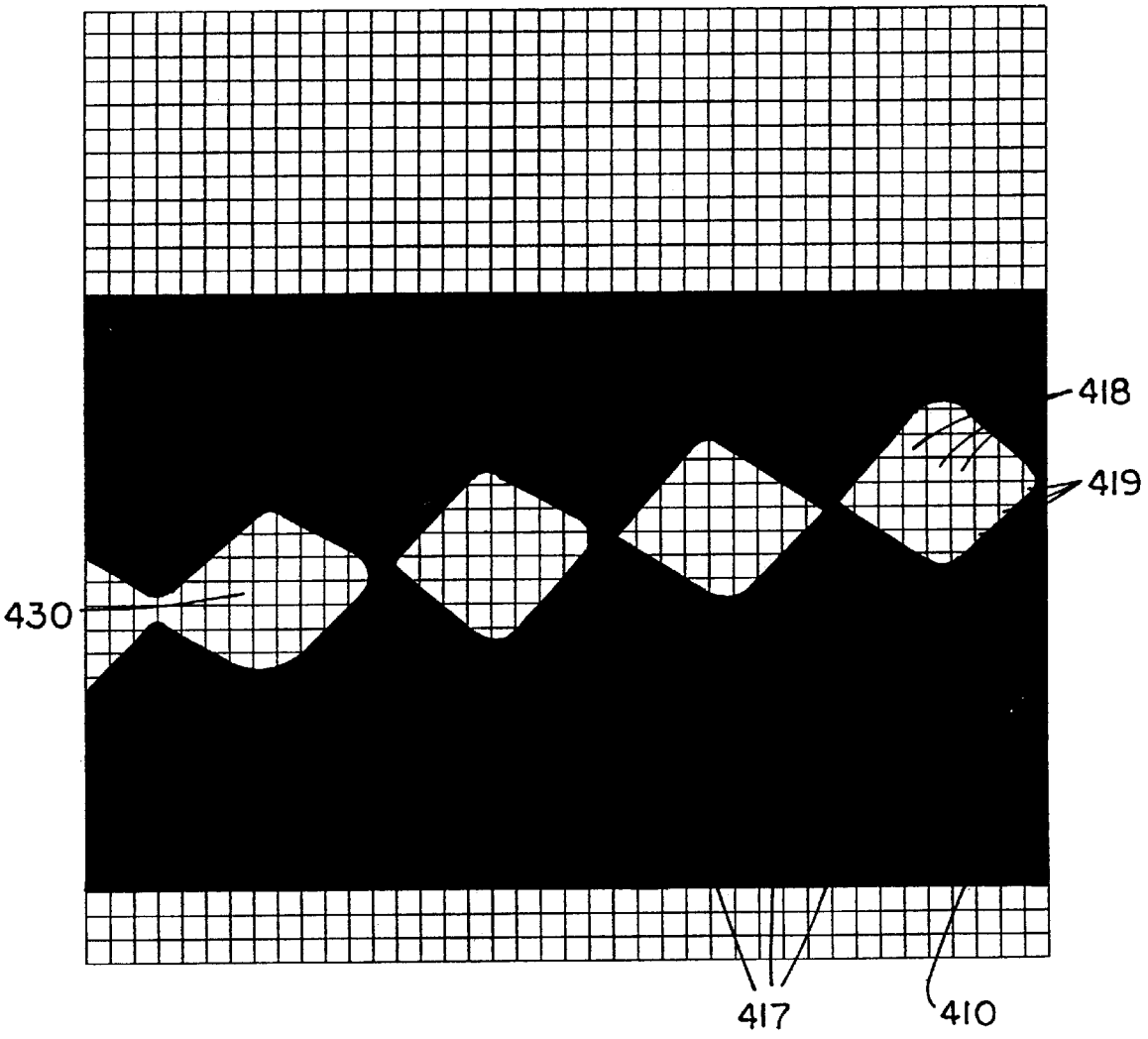
FIG. 4 is a magnified view of a screen with unblocked cells representing a single linear dot pattern.

FIG. 4 depicts the screen 410 after the process film has been removed and the unhardened emulsion has been washed away. The screen cells which were exposed to light have become blocked screen cells 417. The screen cells which were covered by the dot pattern of the process film are unblocked screen cells 418. Unblocked screen cells 418 will allow fluids to pass through the screen 410. The blocked screen cells 417 will not allow such passage. Certain cells are partially blocked and partially unblocked. These partial blocked cells 419 allow fluids to pass through the unblocked portions of the cell.

During printing ink is able to pass through the unblocked screen cells 418 and to contact the substrate so that an ink image in the shape of the screen dot pattern 430 is transferred to the substrate.

FIG. 4 depicts a single dot pattern in unblocked cells 418 and portions of partially blocked cells 419. The areas of screen outside of the blocked cells 419 which appears to be unblocked are not unblocked. Instead they are simply excess screen which in ordinary use would be covered by other dot patterns or blocked cells.

Figure 5:
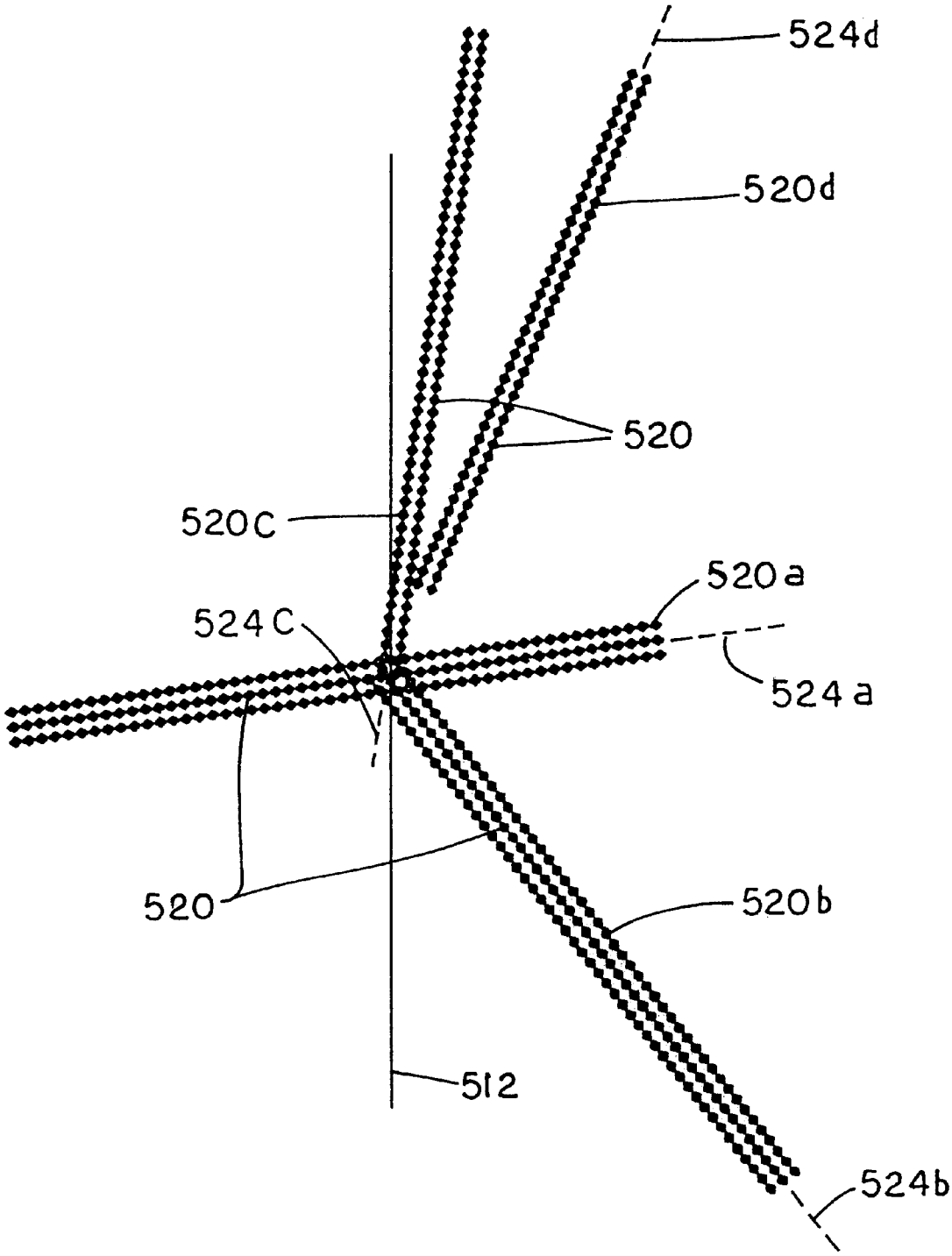
FIG. 5 is a schematic of a single vertical thread from an orthogonal screen with four sets of parallel dot patterns positioned in relation to the thread approximately at the preferred angles.

FIG. 5 depicts the printed image shown by parallel dot patterns 520 for each of the four process colors at approximately preferred angles. Cyan dot pattern 520*a* has an axis 524*a* which passes through the vertical thread 512 at an angle of approximately 82.5 degrees. Magenta dot pattern 520*b* has an axis 524*b* which passes through the vertical thread 512 at an angle of approximately 142.5 degrees. Yellow dot pattern 520*c* has an axis 524*c* which passes through the vertical thread 512 at an angle of approximately 7.5 degrees. Black dot pattern 520*d* has an axis 524*d* which passes through the vertical thread 512 at an angle of approximately 22.5 degrees.

FIG. 5 depicts only several parallel dot patterns for clarity. However, in the preferred embodiment of the invention, there would be between substantially continuous dot patterns for each color. These dot patterns would contain dots of varying sizes depending on the color of the image to be printed. The overlapping of differing dot patterns results in the ability to reproduce virtually any color, shade or tone using only four process colors.

The angles depicted in FIG. 5, i.e., cyan at 82.5 degrees, magenta at 142.5 degrees, yellow at 7.5 degrees, and black at 22.5 degrees, are preferred in the inventive process when using line screens of 60 or 62 (60 or 62 dot-positions per inch). For lines screens of 70 or 82 (70 or 82 dot-positions per inch), the angles of 75 degrees for cyan, 135 degrees for magenta, 0 degrees for yellow and 15 degrees for black are preferred. These angles are each 7.5 degrees less than the corresponding angle measurement in the first preferred embodiment using lines screens of 60 or 62.

The angles depicted in FIG. 5 are necessary to avoid Moire effects which plague prior art screen printed images. It has been discovered through extensive research that these angles, along with the disclosed method of printing, are best suited to minimizing Moire effects.

Figure 6:
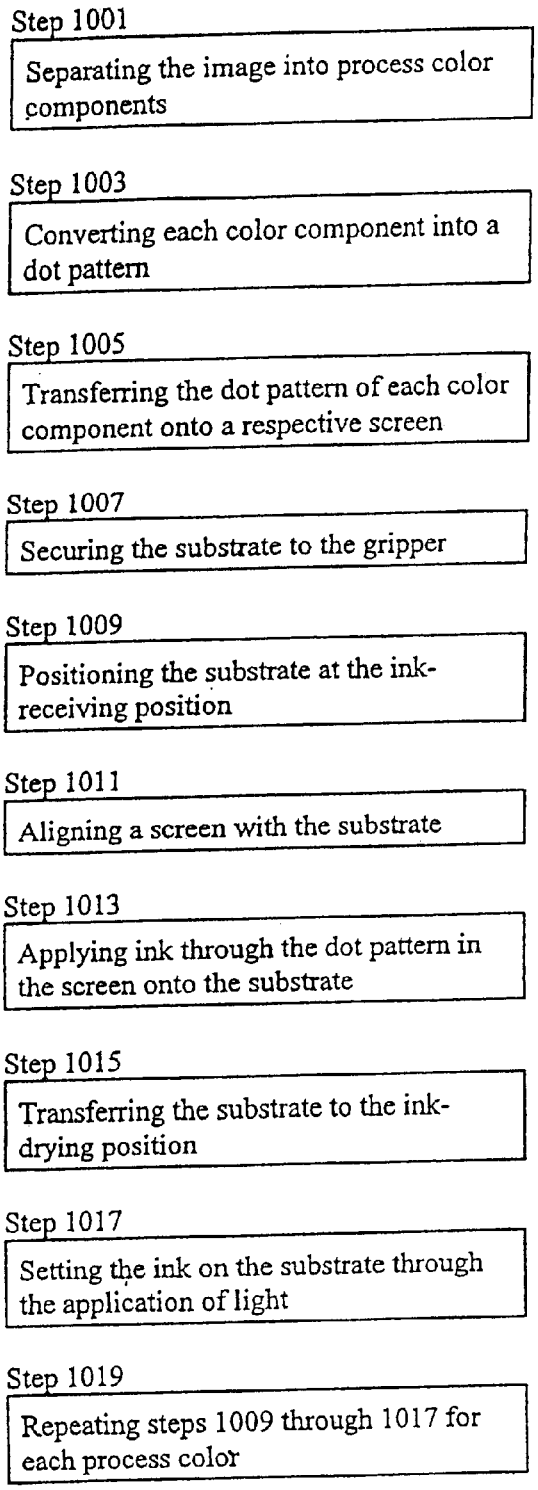
FIG. 6 is a schematic representation of steps used in the inventive method of screen printing which minimizes Moire effects.

FIG. 6 is a schematic representation of steps used in the inventive method of screen printing which minimizes Moire effects. In step 1001, an original image is analyzed and is separated into process color components, preferably cyan, magenta, yellow and black, at a predetermined line count. In step 1003, each color component is converted into a dot pattern for each line. The dot pattern comprises dot-positions which are filled to varying degrees by dots depending on the level of each particular color needed at the dot-position. Preferably there are about either 24, 36, 45, 60, 62, 75 or 82 dot-positions per inch. The number of dot-positions per inch is also referred to as line screen numbers. The dot patterns for each color are preferably printed or otherwise applied to a process film.

Step 1005 involves the transfer of the dot pattern from the process film to a screen in preparation of screen printing. Preferably this transfer is achieved utilizing photo emulsion. During this process the screen is coated with emulsion. Then the process film is positioned adjacent to the screen such that the dot pattern can be negatively transferred to the screen. When the screen and film are properly aligned, light is applied through the process film onto the emulsion covered screen. The light acts to harden the emulsion which it contacts. The emulsion which is shaded by the dot pattern of the process film remains unhardened and water soluble. After light is applied to the screen to sufficiently harden the exposed emulsion, the film is removed. The screen is then washed or otherwise treated by fluid so that the unhardened emulsion is stripped from the screen. This process results in the transfer of the dot pattern from the process film to the screen, albeit in a rectilinear shape. The dot pattern is depicted by unblocked screen cells which are bounded by blocked screen cells.

Step 1007 involves securing the substrate to the gripper. The gripper is an elongate U-shaped member. The substrate is slid into the cavity of the gripper where it is secured. In step 1009 the gripper positions the substrate properly in the ink-receiving position. It is noted that for the initial ink application, the gripper may be in the proper position when the substrate is fed into it, so that the gripper does not necessarily initially move to position the substrate.

Step 1011 involves the alignment of the screen with the substrate. Preferably the screen and substrate are aligned using register marks. This means that during the first ink printing onto the substrate a register mark, typically a target-type mark, is printed on the substrate outside of the image area. The mark is preferably created during the dot pattern transfer step on each screen. Thus the mark can be realigned with in subsequent printings.

In step 1013 ink is passed through the unblocked cells of the screen onto the substrate. This step preferably involves the pouring of ink onto the screen and forcing the ink through the unblocked cells through the use of a squeegee. Ink cannot pass through the blocked cells during this step, ensuring that the rectilinear dot pattern is reproduced on the substrate.

Step 1015 involves the transfer of the substrate from the ink-receiving position to the ink-drying position. This step is preformed by the gripper. The gripper is able to travel linearly between the screen printing device and the ink dryer. As it moves, it pulls the substrate along with it. The gripper precisely finds its "home" position within each device so that the substrate is repeatedly precisely positioned within each device. Thus, manual adjustment of the substrate is unnecessary.

Step 1017 involves setting the ink in position on the substrate. Preferably this step is performed using UV light application. Preferably during UV light application the substrate is passed under UV light emitters. At the same time the substrate is cooled so that the heat from the light causes insubstantial deformation. Step 1019 involves repeating steps 1009 though 1017 for each process color used in the printing process. After each process color has been printed on the substrate and set, the reproduction of the image is complete.

Figure 7:
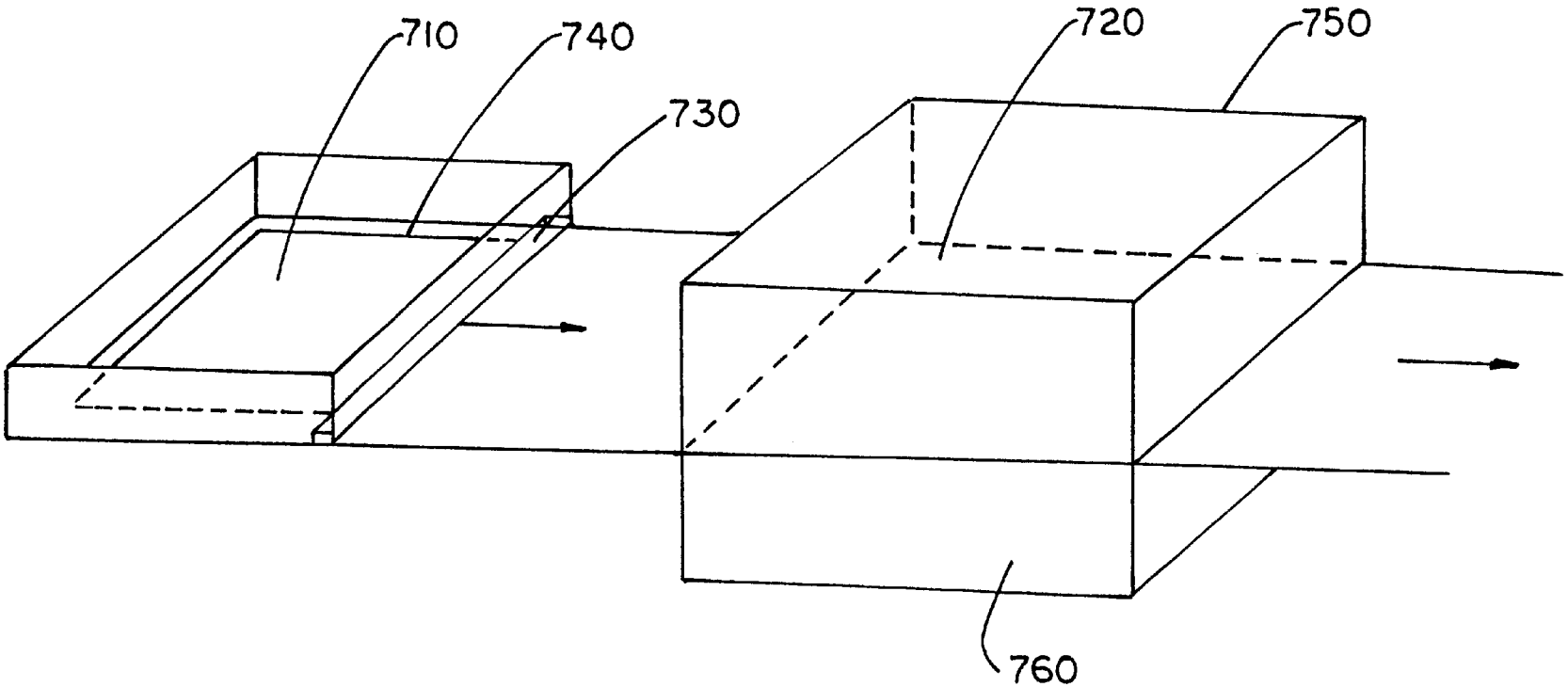
FIG. 7 is a plan view of a preferred arrangement of a single ink-receiving position and ink-drying position.

FIG. 7 depicts the arrangement of a single ink-receiving position 710 and a single ink-drying position 720. In the preferred method, there is a pair of ink-receiving positions and ink-drying positions for each color to be printed. The ink-receiving positions and ink-drying positions are preferably arranged linearly.

For a single ink application, a substrate 740 is secured to the substrate-guide or gripper 730. Gripper 730 is preferable an elongate U-shaped member which is able to receive an end of substrate 740 and clamp on or otherwise secure the substrate 740. The cavity of gripper 730 faces upstream so that substrate 740 can be pulled downstream (as indicated by the arrows) as gripper 730 travels downstream. A screen (not shown) is positioned above the substrate 740 and is aligned for printing as is known in the art. After ink has been forced through the screen onto substrate 740, gripper 730 pulls substrate 740 out of ink receiving position 710 and into a drying unit 750. Gripper 730 automatically positions substrate 740 into proper ink-drying position 720. UV lights within drying unit 750 dry the ink on substrate 740. While UV light is applied to substrate 740, the lower portion 760 of drying unit 750 transfers heat away from substrate 740, typically through the use of cooled water passing immediately beneath the table on which the substrate rests. In this manner, substrate 740 experiences minimal deformation.

After sufficient drying, gripper 730 pulls substrate 740 out of ink-drying position 720. For the application of additional inks, gripper 730 pulls substrate 740 into another ink-receiving position and the process is repeated. Because gripper 730 transfers substrate 740 between devices automatically, substrate 740 does not require re-registering with each subsequent device. This allows for much greater precision than is currently performed in the art.

What is claimed is:

1. A method of precisely printing a multicolor image onto a substrate which minimizes the moire effect and substrate deformation comprising the steps of:

providing a first screen having first unblocked dots, said first unblocked dots positioned in substantially linear patterns along parallel axes at a first angle relative to the vertical;

providing a second screen having second unblocked dots, said second unblocked dots positioned in substantially linear patterns along parallel axes at a second angle 60 degrees greater than the first angle;

providing a third screen having third unblocked dots, said third unblocked dots positioned in substantially linear patterns along parallel axes at a third angle 285 degrees greater than the first angle;

securing the substrate in a fixed position relative to a substrate-guide;

aligning the first screen with the substrate and applying a first ink to the first screen so that the first ink passes through the first unblocked dots onto the substrate;

transferring the substrate to an ink-drying position while retaining the fixed position relative to the substrate-guide;

drying the first ink on the substrate with UV light treatment;

transferring the substrate to a second ink-receiving position while retaining the fixed position relative to the substrate-guide;

aligning the second screen with the substrate and applying a second ink to the second screen so that the second ink passes through the second unblocked dots onto the substrate;

transferring the substrate to an ink-drying position while retaining the fixed position relative to the substrate-guide;

drying the second ink on the substrate with UV light treatment;

transferring the substrate to a third ink-receiving position while retaining the fixed position relative to the substrate-guide;

aligning the third screen with the substrate and applying a third ink to the third screen so that the third ink passes through the third unblocked dots onto the substrate; and drying the third ink on the substrate with UV light treatment.

2. The method of claim 1 further comprising the steps of:

providing a fourth screen having fourth unblocked dots, said fourth unblocked dots positioned in substantially linear patterns along parallel axes at a fourth angle 300 degrees greater than the first angle;

transferring the substrate to a fourth ink-receiving position while retaining the fixed position relative to the substrate-guide;

aligning the fourth screen with the substrate and applying a fourth ink to the fourth screen so that the fourth ink passes through the fourth unblocked dots onto the substrate;

transferring the substrate to an ink-drying position while retaining the fixed position relative to the substrate-guide; and drying the fourth ink on the substrate with UV light treatment.

3. The method of claim 2 wherein the substrate-guide is a gripper which secures the substrate by pinching each of the substrate's opposite faces and automatically moves between ink-receiving and ink-drying positions such that the substrate does not require re-registration between applications of ink.

4. The method of claim 3 wherein the first ink is cyan, the second ink is magenta, the third ink is yellow and the fourth ink is black.

5. The method of claim 4 wherein the first angle is about 75 degrees.

6. The method of claim 4 wherein the first angle is about 82.5 degrees.

7. A repeatable method of precisely printing a multicolor image on a substrate which minimizes the moire effect and substrate deformation comprising the steps of:

separating the image into cyan, magenta, yellow and black components at a predetermined line count;

converting the cyan component into a dot pattern comprising dots positioned on a cyan process film along axes at an first angle relative to the vertical;

converting the magenta component into a dot pattern positioned on a magenta process film along axes at an angle of about 60 degrees relative to the first angle;

converting the yellow component into a dot pattern positioned on a yellow process film along axes at an angle of about 285 degrees relative to the first angle;

converting the black component into a dot pattern positioned on a black process film along axes at an angle of about 300 degrees relative to the first angle;

transferring the dot pattern of each component from the respective process film to a respective cyan, magenta, yellow and black screen using photo emulsion, the screens having a plurality of screen cells;

securing the substrate in a fixed position relative to a gripper;

positioning the substrate in a cyan ink-receiving position while retaining the fixed position relative to the gripper;

aligning the cyan screen with the substrate and applying cyan ink to the cyan screen for flowing onto the substrate through the dot pattern;

transferring the substrate to an ink-drying position while retaining the fixed position relative to the gripper;

setting the cyan ink on the substrate;

transferring the substrate to a magenta ink-receiving position while retaining the fixed position relative to the gripper;

aligning the magenta screen with the substrate and applying magenta ink to the magenta screen for flowing onto the substrate through the dot pattern;

transferring the substrate to an ink-drying position while retaining the fixed position relative to the gripper;

setting the magenta ink on the substrate;

transferring the substrate to a yellow ink-receiving position while retaining the fixed position relative to the gripper;

aligning the yellow screen with the substrate and applying yellow ink to the yellow screen for flowing onto the substrate through the dot pattern;

transferring the substrate to an ink-drying position while retaining the fixed position relative to the gripper;

setting the yellow ink on the substrate;

transferring the substrate to a black ink-receiving position while retaining the fixed position relative to the gripper;

aligning the black screen with the substrate and applying black ink to the black screen for flowing onto the substrate through the dot pattern; and transferring the substrate to an ink-drying position while retaining the fixed position relative to the gripper;

setting the black ink on the substrate.

8. The method of claim 7 wherein each dot pattern's dots merge into one another along the axis of the pattern when the dots fill at least about 30% of the dot-position.

9. The method of claim 7 wherein each dot pattern's dots merge into one another along an axis perpendicular to the axis of the pattern when the dots fill at least 65% of the dot-position.

10. The method of claim 7 wherein the inks are set on the substrate through the application of UV light.

11. The method of claim 10 wherein the substrate is cooled during the application of UV light so that each end of the substrate is distorted by less than 1/32inch, enabling precise alignment with subsequent screens.

12. The method of claim 7 wherein the screen cells are arranged orthogonally.

13. The method of claim 7 wherein each dot in each dot pattern has a maximum size defined by a dot-position.

14. The method of claim 13 wherein each dot pattern comprises 24 dot-positions per inch.

15. The method of claim 13 wherein each dot pattern comprises 36 dot-positions per inch.

16. The method of claim 13 wherein each dot pattern comprises 45 dot-positions per inch.

17. The method of claim 13 wherein each dot pattern comprises 62 dot-positions per inch.

18. The method of claim 13 wherein each dot pattern comprises 70 dot-positions per inch.

19. The method of claim 13 wherein each dot pattern comprises 82 dot-positions per inch.

20. The method of claim 7 wherein the cyan ink is applied first, the magenta ink is applied second, the yellow ink is applied third and the black ink is applied fourth.

* * * * *